US005593059A

United States Patent [19]

Neilson

[11] Patent Number: 5,593,059

[45] Date of Patent: Jan. 14, 1997

[54] PROTECTIVE NEWSPAPER DELIVERY RECEPTABLE

[76] Inventor: Kirsten L. Neilson, 434 Oak Creek Dr. South, Vadnais Heights, Minn. 55127, by Larry W. Neilson, general conservator

[21] Appl. No.: 455,352

[22] Filed: May 31, 1995

[51] Int. Cl.[6] ..... B65D 51/00

[52] U.S. Cl. ..... 220/229; 220/359; 220/657; 220/659; 232/1 C; 406/112

[58] Field of Search ..... 232/1 C, 17, 33, 232/38, 39; 220/359, DIG. 13, 604, 612, 613, 622, 657, 659, 265, 281; 229/105, 114, 81, 82, 84; 215/232, 263; 406/110, 111, 112, 147–150, 176–180

[56] References Cited

U.S. PATENT DOCUMENTS

| | | | |
|---|---|---|---|
| 919,857 | 4/1909 | Hansen | 220/622 |
| 3,086,674 | 4/1963 | Scheuerman . | |
| 3,116,927 | 1/1964 | Kuhlman | 220/229 X |
| 3,144,984 | 8/1964 | Ross | 232/1 C |
| 3,181,782 | 5/1965 | Monroe | 232/1 C X |
| 3,899,100 | 8/1975 | Rigaud . | |
| 4,120,446 | 10/1978 | Fuemmeler | 232/17 |
| 4,138,055 | 2/1979 | Harrison | 232/1 C |
| 4,165,011 | 8/1979 | Holk, Jr. | 220/612 |
| 4,260,090 | 4/1981 | Gross . | |
| 4,308,989 | 1/1982 | Elsinger | 232/1 C X |
| 4,328,904 | 5/1982 | Iverson . | |
| 4,381,062 | 4/1983 | Taquoi | 220/612 X |
| 4,413,770 | 11/1983 | Nye | 232/38 X |
| 4,884,717 | 12/1989 | Bussara | 220/229 |
| 4,905,890 | 3/1990 | Larsen et al. . | |
| 4,923,114 | 5/1990 | Fiske, Jr. | 232/1 C X |
| 4,962,862 | 10/1990 | Farrington et al. | 220/359 X |
| 5,114,068 | 5/1992 | Reil et al. | 220/359 X |
| 5,165,564 | 11/1992 | Prout et al. . | |

*Primary Examiner*—Allan N. Shoap
*Assistant Examiner*—Robin A. Hylton
*Attorney, Agent, or Firm*—Robert C. Baker

[57] ABSTRACT

This weather-shielding protective newspaper delivery receptacle serves to completely enclose its contents and has no removable or hinged door for access to its interior. The receptacle consists essentially of a tapered elongated tube having its smaller end terminating in a solid immovable wall closure and having its large end terminating at a rim edge. The rim edge is equipped with a planar flexible wall permanently united about its perimeter to the rim edge. The wall has intersecting slits that form plural flaps extending from the perimeter to a central location of the flexible wall. The flaps are deformed inwardly as a newspaper is inserted into the tube and are deformed outwardly as a newspaper is removed from the tube through the flexible wall. The flaps are sufficiently resilient to return to a non-deformed state after deformation. The flexible wall is sloped so as to extend downwardly and underneath the uppermost portion of the rim edge during use.

6 Claims, 2 Drawing Sheets

PROTECTIVE NEWSPAPER DELIVERY RECEPTABLE

BACKGROUND OF THE INVENTION

This invention relates to a weather-shielding protective newspaper delivery receptacle and more particularly to a receptacle of that type having the feature that it completely encloses its contents and has no removable or hinged door for access to the interior of it.

It has been observed that the most popular newspaper receptacles in current use have an open end. An open end permits easy insertion and removal of a newspaper but exposes the newspaper to potential damage from rain, snow, dust, sleet, or the like under windy conditions. Nevertheless, the demands of economy have thrusted these open ended newspaper receptacles into high prominence.

Newspaper recipients, that is, the persons who read the newspapers that are delivered, likewise desire economy, but even to a greater extent desire clean newspapers and dislike intensely the bother of trying to read messy pages of a damp, wet and dirty newspaper. A few experiences along that line bring one to a determined resolve to get a fresh newspaper to replace the messy one.

Special delivery of fresh newspapers to replace messy ones is not economical for the newspaper industry. They would gladly avoid that expense, but not if it means replacing that expense with something even more expensive such as newspaper receptacles equipped with special hinged closures similar to those employed for rural mail boxes. Further, the newspaper industry is not interested in the delay associated with opening and closing a receptacle. That adds additional labor and time to the delivery of newspapers.

A critical requirement for any newspaper delivery receptacle is that it must be simple in structure and economical in cost and permit quick, easy delivery insertion of a newspaper with little effort and minimal time. Until this invention, satisfying those requirements, and in addition fully shielding and protecting a newspaper from weather damage, has been an unsolved dilemma.

SUMMARY OF THE INVENTION

This invention provides a weather-shielding protective newspaper delivery receptacle that completely encloses its contents and has no removable or hinged door for access to the interior thereof. The receptacle consists essentially of a tapered elongated tube and a planar flexible wall. The tube has a smaller end and a larger end and a longitudinal axis extending between its smaller end and its larger end. The structure of the tube terminates in a solid immovable wall closure at the smaller end, whereas the tube terminates at a rim edge at its larger end. The rim edge at the larger end of the tube is equipped with the planar flexible wall, and this flexible wall is permanently united about its perimeter to the rim edge. The flexible wall functions as the sole entrance for placing a newspaper inside the tube and sole exit for removing a newspaper from the tube. The sole structure of the flexible wall permitting placement of a newspaper inside the tube and removal of a newspaper from the tube consists of intersecting slits that form plural flaps extending from the perimeter to a central location of the flexible wall. The flaps are deformed inwardly of the tube as a newspaper is inserted into the tube through the flexible wall and are deformed outwardly of the tube as a newspaper is removed from the tube through the flexible wall. Further, the flaps are sufficiently resilient to return to a non-deformed state after deformation and thereby shield a newspaper in the tube from dirt, snow, rain, sleet, and other weather and wind-driven conditions. The rim edge of the tube and the flexible wall are both at a sloped orientation with respect to the longitudinal axis of the tube such that the mounting of the receptacle to perform its function as a newspaper delivery receptacle-with its longitudinal axis in substantially horizontal orientation and with the portion of the rim edge that has the greatest projection in the axis direction oriented uppermost-results in placement of the flexible wall at an angular orientation with respect to the vertical and with the slope of the flexible wall oriented downwardly and underneath the portion of the rim edge of the tapered tube having the greatest projection in the axis direction.

Other special features and benefits and advantages of the invention will be evident as this description proceeds.

DESCRIPTION OF THE PREFERRED EMBODIMENT(s)

Figure 1:
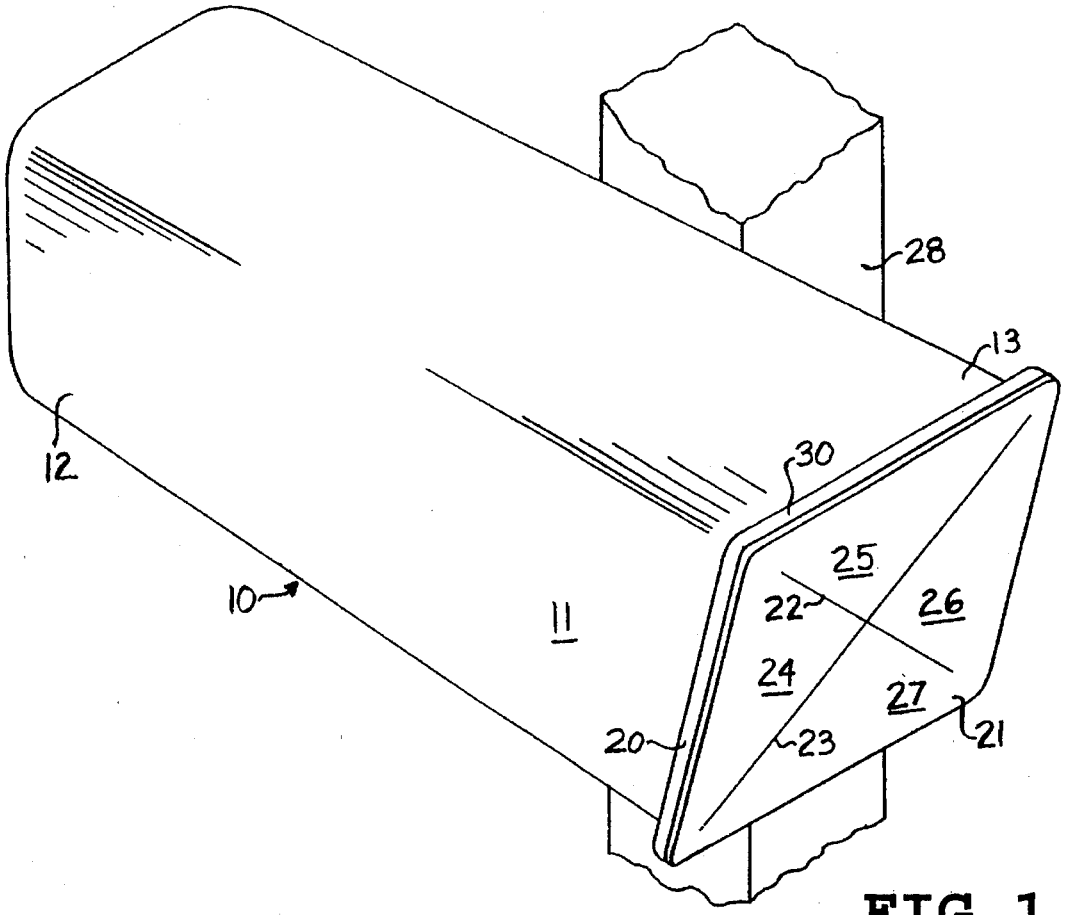
FIG. 1 is a schematic perspective view of the new protective newspaper delivery receptacle of this invention as mounted on a mounting post (partially broken away), particularly illustrating the slits that form the flaps in the flexible wall.
Figure 2:
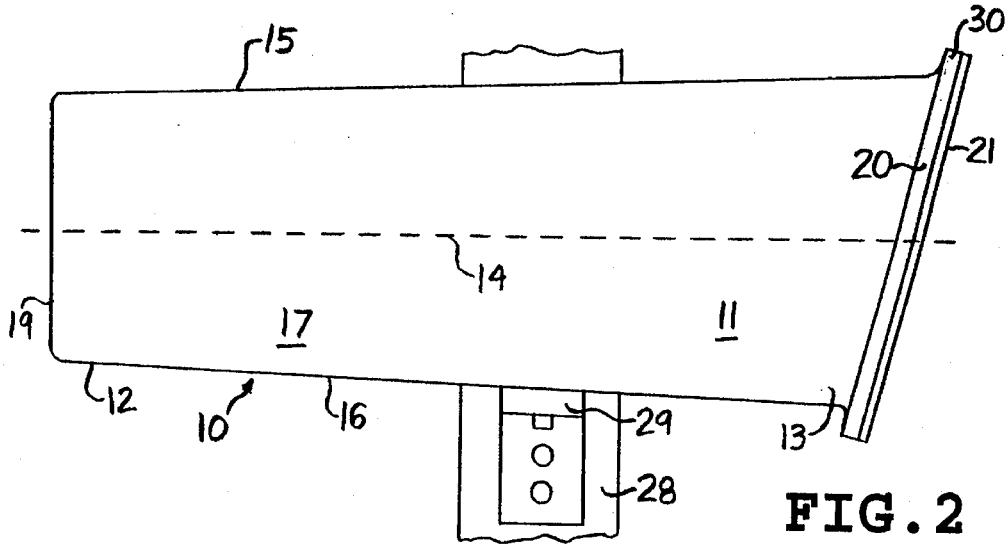
FIG. 2 is a side elevational view of the new receptacle as mounted on a mounting post (partially broken away), particularly illustrating the taper of the tube and the slope of the tube rim edge and flexible wall relative to the longitudinal axis of the tube.

Referring to the drawings, the new newspaper delivery receptacle 10 consists essentially of a tapered elongated tube 11 having a smaller end 12 and a larger end 13 and a longitudinal axis 14 extending between those ends. The tube has a top wall 15, bottom wall 16, and side walls 17, 18. It has a tube structure that terminates at the small end in a solid immovable wall 19, which is a closure wall at that end. In fact, that wall at the small end is ideally formed simultaneously with the molding of the elongated tube, and is integral with the tube. The taper of the tube should be sufficient to facilitate removal of the tube from a mold but need not be particularly significant except for that benefit. Reinforcing ribs or beams or other surface features for the tube (both internally and externally), as well as small slits or holes in the bottom wall 16 for easy removal of newspaper dust from the interior of the tube, may be employed but are not shown or illustrated in the drawing.

The larger end 13 of the elongated tube terminates at a rim edge 20. This rim edge is more or less an enlargement in the nature of a bead or flange of preferably small character about the terminal edge of the larger end 13 of the tube 11. The rim edge is equipped with a planar flexible wall 21 permanently united about its perimeter to the rim edge. The planar flexible wall in effect completes the enclosure of the interior of the tube. It should be noted that there is no removable door and no hinged openable door for access to the interior. Simplicity of the total structure is its dominant feature.

Figure 3:
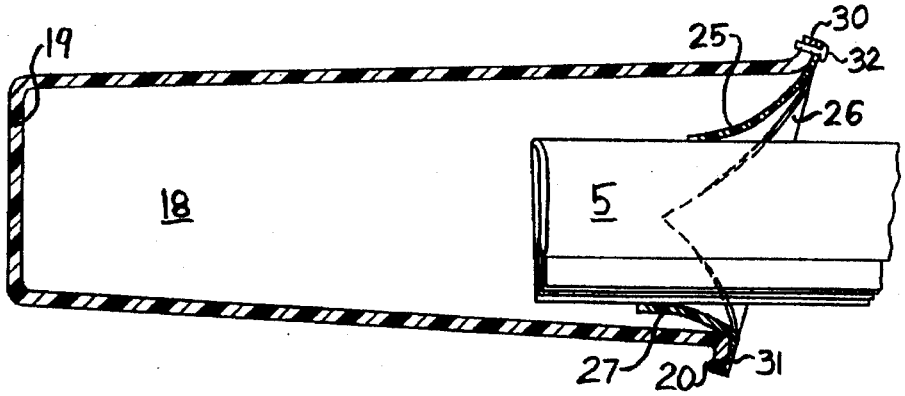
FIG. 3 is a longitudinal sectional view taken along a vertical plane within which the longitudinal axis of the receptacle lies, and particularly illustrates the flexible wall performance on insertion of a newspaper through it, and also illustrates an adhesive and/or mechanical attachment of the perimeter of the flexible wall to the rim edge of the tapered tube.
Figure 4:
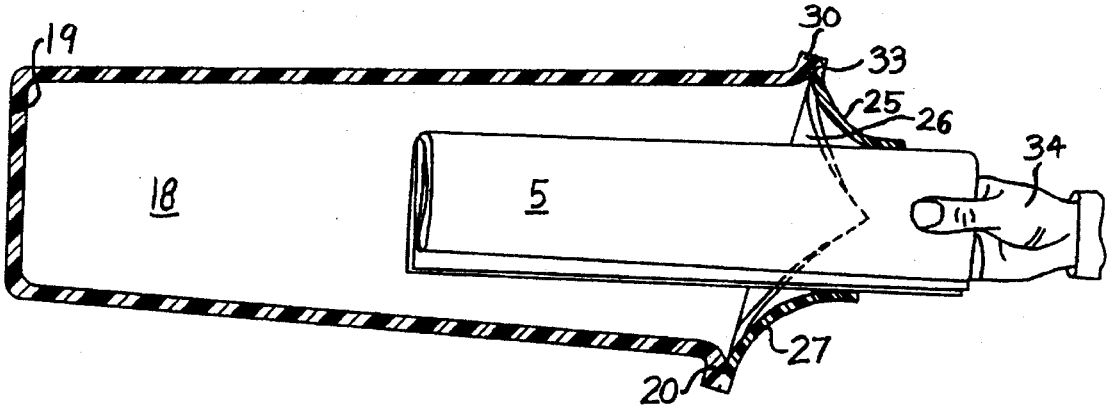
FIG. 4 is a longitudinal sectional view taken along a vertical plane within which the longitudinal axis of the receptacle lies, and particularly illustrates the flexible wall performance on removal of a newspaper through it, and also illustrates a fused or heat seal bonding or unification between the rim edge of the tube and the perimeter of the flexible wall.

The flexible wall 21 at the larger end of the tapered elongated tube has a very special function. It functions not only as the sole entrance for placing a newspaper 5 inside the tube but also as the sole exit for removing a newspaper from the tube. The sole structure of the flexible wall permitting these features of inserting and removing a newspaper consists of intersecting slits 22, 23 in the flexible wall. The number of slits may vary but should be great enough to form at least four flaps 24, 25, 26, 27. The slits as well as the flaps extend from the perimeter of the flexible wall toward the center of the flexible wall. The plural flaps have a special feature, namely that of being deformable in an easy convenient manner. Insertion of a newspaper 5 through the flexible wall 21 at a more or less central location of the flexible wall effectively causes the flaps 24, 25, 26, 27 to be deformed-that is, pushed inwardly of the tube 11, as illustrated in FIG. 3. Conversely, FIG. 4 illustrates that the flaps 24, 25, 26, 27 are pushed outwardly of the tube 11 during the removal of a newspaper from the flexible tube, that removal being through the flexible wall by hand 34. The hand is first inserted through the flexible wall to grip the newspaper within the receptacle, and then the hand and newspaper are pulled outwardly, which action deforms the flaps outwardly, as illustrated in FIG. 4.

The material of the flexible wall 21, while deformable to permit ingress and egress of a newspaper through it, is not permanently deformed by loading or pushing a newspaper inwardly through it, or by removing a newspaper outwardly through it. The material has sufficient resiliency to return to a non-deformed state after deformation. This return to a non-deformed state is critically significant, for it permits the flexible wall itself to function for loading and unloading of newspapers through it. The flexible wall also functions as a shield during times when nothing is loaded or passed through it. The shielding effect of the wall comes about because it is basically a planar wall, and the flaps return to a non-deformed state after relief from the pressures causing deformation. After a newspaper is no longer moved through the flexible wall either into or out of the receptacle, the pressures causing deformation are gone or relieved, and the flaps return to their non-deformed state (which is in essence planar or substantially so in the flexible wall.) Thus, the shielding planar wall has the effect of protecting the contents such as a newspaper from dirt, snow, rain, sleet, and other weather and wind-driven conditions. This shielding effect is substantial even if slight imperfections may be evident when the flaps return to their non-deformed condition.

A significant feature of both the rim edge 20 and the flexible wall 21 of the receptacle is that of a sloped orientation of each with respect to the longitudinal axis 14 of the tube 11. This sloped orientation is such that the mounting of the receptacle to perform its function as a newspaper delivery receptacle places the flexible wall 21 in a special orientation under the uppermost portion 30 of the rim edge. That uppermost portion 30 is the portion of the rim edge that has the greatest projection in the axis 14 direction of the tube 11. In mounting the tube for its function as a newspaper delivery receptacle, which illustratively is done on a mounting post 28 at a bracket 29, the longitudinal axis 14 is put in substantially horizontal orientation and the portion 30 of the rim edge is placed uppermost. This results in the placement of the flexible wall at an angular orientation with respect to the vertical. Still further, the slope of the rim edge as well as the flexible wall is oriented downwardly and underneath the uppermost portion 30 of the rim edge. This slope further assists to protect the newspaper contents of the receptacle from weather conditions.

Molding of the tapered elongated tube is the preferred way to manufacture it. The materials out of which the tube may be formed can vary. Nevertheless, the most preferred materials are plastics sometimes referred to as organic plastics (including thermoplastics). Heat-softenable plastic materials permit a variety of different molding techniques to be employed in manufacturing the tube. Many different plastics may be employed for the tube structure. Experts are aware of such plastics. Some such plastics are: polyethylene, polypropylene, polystyrene, and vinyl types. The most ideal plastics, however, for fabricating the tube part of the structure are those that combine the attributes of low cost and receptiveness for unification of the flexible wall to them about the rim edge of the larger end of the tube.

The flexible wall 21 preferably is fabricated from rubber or rubber-like materials, including both natural and synthetic elastomers that possess the yieldability and resiliency to return to a non-deformed state in the manner described above. Interestingly, however, some plastic polymers when fabricated into thin sheets exhibit the minimal requirements for the flexible wall structure in terms of flexibility for deformation and sufficient resiliency to return to a non-deformed state after deformation. Thus, it is conceivable that the tubular part as well as the flexible wall part of the receptacle may be formed from plastics material having the same polymeric character. This permits unification of the perimeter of the flexible wall with the rim edge in a manner associated with heat sealing 33 or fusion of the parts together (see FIG. 4). Even when the tube 11 and rim edge 20 are formed of a different polymeric material from that employed for the flexible wall 21, it is in some instances possible to seal by heat or fusion. On the other hand, gluing of the parts together or fixing them and unifying them by means of an adhesive 31 (see FIG. 3) is also useful. In fact, unification of the perimeter of the flexible wall to the rim edge of the tube by adhesive or gluing was the manner of unification first conceived of by the inventor here. Mechanical means of unification as by screws 32 or the like may also be employed. Thus, unification may be effected between the perimeter of the flexible wall and the rim edge of the tube by using a variety of means to accomplish that result, and various combinations of different means may also be used to effect sealing or unification in a permanent manner. A permanent unification or sealing is effected whenever the unification is such that severance or splitting of the flexible wall from the rim edge is not realistically capable of being accomplished or even considered as an option for receptacle access at any time during actual use of the receptacle as a newspaper delivery receptacle. There are many technological advancements dealing with means for such permanent unification, and the specific means or specific adhesives employed may vary consistent with those technological advancements.

An unusual benefit arising from practice of this invention is that of the safety or security the receptacle provides in terms of concealing whether delivered newspapers have been removed by the intended recipient. The internal accumulation of unremoved newspapers is not visible to passers-by, and this accumulation is therefore not a signal to vandals or criminals that the premises are unattended.

Those skilled in the art will readily recognize that this invention may be embodied in still other forms than specifically illustrated without departing from the spirit or essential characteristics of it. All variations that come within the meaning and range of equivalency for the claims are therefore intended to be embraced thereby.

That which is claimed is:

1. A weather-shielding protective newspaper delivery receptacle that completely encloses its contents and has no removable or hinged door for access to the interior thereof, said receptacle consisting essentially of a tapered elongated tube having a smaller end and a larger end and a longitudinal axis extending between said smaller and larger ends, said tube having its tube-structure terminating in a solid immovable wall closure at its smaller end and having its tube structure terminating at a rim edge at its larger end, said rim edge at the larger end of said tube being equipped with a planar flexible wall permanently united about its perimeter to said rim edge, said flexible wall functioning as the sole entrance for placing a newspaper inside said tube and sole exit for removing a newspaper from said tube, the sole structure of said flexible wall permitting placement of a newspaper inside said tube and removal of a newspaper from said tube consisting of intersecting slits that form plural flaps extending from the perimeter to a central location of said flexible wall, said flaps being deformed inwardly of the tube as a newspaper is inserted into said tube through said flexible wall and deformed outwardly of the tube as a newspaper is removed from said tube through said flexible wall, said flaps being sufficiently resilient to return to a non-deformed state after deformation and thereby shield a newspaper in said tube from dirt, snow, rain, sleet, and other weather and wind-driven conditions, said rim edge and said flexible wall being at a sloped orientation with respect to the longitudinal axis of said tube with a portion of said rim edge projecting more greatly in said longitudinal direction than all other portions of said rim edge such that the mounting of said receptacle to perform its function as a newspaper delivery receptacle, with its longitudinal axis in substantially horizontal orientation and with the portion of the rim edge that has the greatest projection in said longitudinal axis direction oriented uppermost, results in the placement of said flexible wall at an angular orientation with respect to the vertical and with the slope of said flexible wall oriented downwardly and underneath said uppermost portion of the rim edge of said tapered tube having the greatest projection in said longitudinal axis direction.

2. The receptacle of claim 1 wherein said tube consists essentially of plastics material.

3. The receptacle of claim 1 wherein said flexible wall is adhesively united to said rim edge.

4. The receptacle of claim 1 wherein said flexible wall is united by heat sealing to said rim edge.

5. The receptacle of claim 1 wherein said flexible wall is formed of plastics material.

6. The receptacle of claim 1 wherein said flexible wall is formed of elastomeric material.

* * * * *